US012528664B2

(12) United States Patent
Ackermann et al.

(10) Patent No.: US 12,528,664 B2
(45) Date of Patent: Jan. 20, 2026

(54) DEVICE AND METHOD FOR FOLDING SHEETS

(71) Applicant: Heidelberger Druckmaschinen AG, Heidelberg (DE)

(72) Inventors: Herbert Ackermann, Ludwigsburg (DE); Martin Haupt-Terlau, Erdmannhausen (DE); Gerhard Lubberger, Steinheim (DE); Stefan Waldreiter, Erdmannhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 19/172,893

(22) Filed: Apr. 8, 2025

(65) Prior Publication Data

US 2025/0313427 A1 Oct. 9, 2025

(30) Foreign Application Priority Data

Apr. 8, 2024 (DE) ..... 10 2024 109 691.8

(51) Int. Cl.
*B65H 45/14* (2006.01)

(52) U.S. Cl.
CPC ..... *B65H 45/142* (2013.01)

(58) Field of Classification Search
CPC ..... B65H 45/142; B65H 45/14; B65H 37/04; B65H 2403/40; B65H 2301/4521; B65H 2801/06; B65H 2801/27; B65H 2801/15; B65H 45/107; B65H 7/20; B31F 1/10; B31F 7/00
USPC ..... 493/419
See application file for complete search history.

(56) References Cited

U.S. PATENT DOCUMENTS

| | | | | |
|---|---|---|---|---|
| 2,699,331 A * | 1/1955 | Mcgarvey | B65H 45/144 493/450 |
| 4,225,128 A * | 9/1980 | Holyoke | B65H 45/147 493/442 |
| 5,246,415 A * | 9/1993 | Fuss | B65H 45/144 493/28 |
| 5,980,439 A * | 11/1999 | Johnson | B65H 45/144 493/29 |

(Continued)

FOREIGN PATENT DOCUMENTS

| | | |
|---|---|---|
| DE | 560466 C | 10/1932 |
| DE | 3221525 A1 | 2/1983 |
| DE | 102006055301 A1 | 5/2008 |

(Continued)

*Primary Examiner* — Sameh Tawfik
(74) *Attorney, Agent, or Firm* — Laurence A. Greenberg; Werner H. Stemer; Ralph E. Locher

(57) ABSTRACT

A folding unit has two folding rollers with a common folding nip. A first insertion slot has a first insertion plane for a selectively insertable buckle plate and is configured so that a buckle plate mouth of the buckle plate is at an inlet side of the folding nip. A second insertion slot has a second insertion plane for a buckle plate. The second insertion plane is inclined with respect to the first insertion plane and the second insertion slot is designed for the buckle plate mouth of the selectively inserted buckle plate to be arranged on the inlet side of the folding nip. Printing substrates with different properties are processed in a high-quality and highly productive manner in a pocket folding process, especially in buckle folding units of industrial folding machines.

18 Claims, 6 Drawing Sheets

(56) References Cited

U.S. PATENT DOCUMENTS

| | | | | |
|---|---|---|---|---|
| 6,475,129 | B1 * | 11/2002 | Lehmann | B65H 45/147 493/25 |
| 6,743,161 | B2 * | 6/2004 | Dannemann | B65H 45/147 493/34 |

FOREIGN PATENT DOCUMENTS

| | | | |
|---|---|---|---|
| EP | 0511574 | A1 | 11/1992 |
| GB | 290530 | A | 5/1928 |

* cited by examiner

DEVICE AND METHOD FOR FOLDING SHEETS

CROSS-REFERENCE TO RELATED APPLICATION

This application claims the priority, under 35 U.S.C. § 119, of German Patent Application DE 10 2024 109 691.8, filed Apr. 8, 2024; the prior application is herewith incorporated by reference in its entirety.

FIELD AND BACKGROUND OF THE INVENTION

The invention relates to a device for folding sheets with two folding rollers forming a common folding nip. A first insertion slot has a first insertion plane for a selectively insertable folding pocket having a folding pocket mouth. The first insertion slot is configured such that the folding pocket mouth of the selectively inserted folding pocket is arranged on the inlet side of the folding nip. A second insertion slot has a second insertion plane for a selectively insertable folding pocket having a folding pocket mouth. The invention also pertains to a method for folding sheets.

The invention lies in the technical field of the graphic industry and, therein, particularly in the sector of the pocket folding of flexible, sheet-shaped printing substrates or of the industrial, i.e., high-quality and highly productive, production of folded products, for example booklets, preferably from paper, cardboard, paperboard, plastic or composite material, in particular from printed paper.

The industrial folding of sheet-form printing substrates takes place using complex folding machines, which as a rule comprise a feeder for the sheets to be folded, at least one folding assembly having a plurality of folding rollers, and a delivery for the folded products. The folding assemblies of the machine may each comprise pocket folding units and/or knife folding units. Pocket folding units generally comprise a series of folding rollers in a so-called folding roller frame and removable folding pockets and sheet diverters on both sides of the folding roller frame.

German published patent application DE 10 2006 055 301 A1 discloses a pocket folding unit having a plurality of folding rollers and a plurality of folding pockets, the planes of which are each arranged parallel to one another.

Such folding pockets may be formed to be insertable in that, for example, insertion slots for the selectively insertable folding pockets are provided. Insertable folding pockets are implemented, for example, in the "Stahlfolder" folding machines of Heidelberger Druckmaschinen AG of Germany.

German publication DE560466C likewise discloses a pocket folding unit having a plurality of folding rollers and a plurality of folding pockets, wherein the planes of two folding pockets are arranged parallel to one another and the plane of a further folding pocket is arranged so as not to be parallel to these two planes.

British published patent application GB 290530 A discloses a folding pocket (or buckling plate, buckle plate) which is arranged in an angularly adjustable manner.

Producers of graphic products—i.e., for example, printing plants with a pre-press, the actual impression and post-press processing—have the continuing desire for improvement in the product quality while maintaining, or even increasing, the production speed, in particular when processing a large number of different printing substrates, for example paper grades with different thicknesses.

SUMMARY OF THE INVENTION

It is accordingly an object of the invention to provide a device and method for folding sheets which overcome the above-mentioned and other disadvantages of the heretofore-known devices and methods of this general type and which addresses the problem of improving over the prior art, and which makes it possible in particular to process printing substrates with different properties in a high-quality and highly productive manner in a buckle folding process.

With the above and other objects in view there is provided, in accordance with the invention, a device for folding sheets, the device comprising:

- two folding rollers forming a common folding nip with an inlet side and an outlet side;
- a first insertion slot defining a first insertion plane for a selectively insertable buckle plate, the first insertion slot being configured to arrange a buckle plate mouth of a selectively inserted the buckle plate on the inlet side of the folding nip;
- a second insertion slot defining a second insertion plane for a selectively insertable buckle plate, the second insertion plane being disposed with an inclination relative to the first insertion plane; and
- the second insertion slot being configured to arrange a buckle plate mouth of a selectively inserted buckle plate on the inlet side of the folding nip.

In other words, the device according to the invention for folding sheets, in a particular a buckle folding device or buckle folding unit, also referred to as a pocket folding unit, comprising two folding rollers with a common folding nip which has an inlet side and an outlet side, comprising a first insertion slot with a first insertion plane for a selectively insertable folding pocket having a folding pocket mouth, wherein the first insertion slot is designed such that the folding pocket mouth of the selectively inserted folding pocket is arranged on the inlet side of the folding nip, and comprising a second insertion slot with a second insertion plane for a selectively insertable folding pocket having a folding pocket mouth, is characterized in that the second insertion plane is formed with an inclination with respect to the first insertion plane, and in that the second insertion slot is designed such that the folding pocket mouth of the selectively inserted folding pocket is arranged on the inlet side of the folding nip.

With the above and other objects in view there is also provided, in accordance with the invention, a method for folding sheets, wherein a device according to the invention is used. The method is characterized in that, for a first folding task, the selectively insertable folding pocket is inserted into the first insertion slot and, for a second folding task, the selectively insertable folding pocket is inserted into the second insertion slot.

The invention advantageously makes it possible to process printing substrates with different properties in a high-quality and highly productive manner in a pocket folding process. The invention is used, for example, in buckle folding units of industrial folding machines.

In the successive processing of different printing substrates in folding machines, i.e. in subsequent folding tasks, it is possible for certain printing substrates and thus a specific folding task to cause problems. These problems may arise in particular in the overlapping feed of the sheets and in the overlapping folding of the sheets in the folding pockets, since, in the process, the sheets at least partially run past one another in the region of the respective folding pocket mouth. Therefore, comprehensive tests were undertaken to investigate how to avoid these problems. In the process, the solution according to the invention was discovered. Accordingly, the folding result can be decisively improved when, for specific folding tasks, use is made not of the "standard" insertion slot but of an insertion slot that is inclined with respect thereto. As a result of the inclination or the altered angle, successive sheets that overlap one another (sheets in an overlapping stream) likewise run past one another with altered angles, and the problem is avoided or at least reduced. The optimum angle, ultimately found in the tests, for the inclination of the folding pocket represents a compromise: if one folding pocket is inclined more steeply, a sheet to be folded enters it flatter and thus better, but on the other hand, this sheet emerges from the folding pocket more steeply and therefore worse.

Furthermore, it was established in the tests that it may be additionally advantageous to arrange the first two or the first three folding rollers of the roller frame (i.e. not the upstream roller) in a manner offset, in particular upward, by a few millimeters-compared with a prior art device that is not according to the invention. This improves the respective entry angle of the sheet to be folded from a folding nip between the folding rollers arranged in an offset manner in the downstream folding pocket.

Via the respective buckle plate mouth (folding pocket mouth, or mouth for short), the sheets to be folded run successively or as an overlapping stream into and back out of the folding pocket(s). In alternative terminology, the sheets run to and fro in the buckle plates in succession or in an overlapping stream.

The term "inclination" is intended to be understood as follows in this application with regard to insertion planes: an insertion plane at an inclination with respect to another insertion plane encloses a non-zero angle with the other insertion plane; or put another way: the two insertion planes are not parallel to one another.

The term "selectively" is intended to be understood as follows in this application with regard to folding pockets: depending on the folding task to be completed by the device, for example thinner or thicker printing substrate to be folded, a choice is made (automatically or by the operating personnel) as to whether a folding pocket (i.e., buckle plate) for the folding is arranged in the first insertion slot or in the second insertion slot. During folding, the folding pocket is thus arranged in the respectively selected insertion slot. It is also possible for sheet diverters to be arranged selectively, i.e. they are arranged where selectively no folding pockets are arranged. Thus, for example, either a folding pocket or alternatively a sheet diverter is arranged, preferably in each case in an insertion slot.

The buckle plate, or folding pocket, that is selectively insertable into the first insertion slot (or slot for short)—and removable therefrom again—and the buckle plate, or folding pocket, that is selectively insertable into the second insertion slot (or slot for short)—and removable therefrom again—are structurally identical and in particular the same buckle plate; alternatively, they may be two buckle plates of the same type or two at least similar buckle plates.

The preferred developments of the invention that are individually described herein may be combined, unless technically ruled out, with one another.

One development may be characterized in that the selectively insertable folding pocket is arranged either in the first insertion slot or in the second insertion slot, i.e. has been inserted and can be removed therefrom again.

One development may be characterized in that the device comprises a roller frame with the two folding rollers and at least two further folding rollers, preferably with a total of six, seven, eight or nine folding rollers. One development may be characterized in that the rolling frame has a zigzag arrangement, i.e. that the connecting lines between the axes of rotation of the folding rollers of the roller frame jointly form a zigzag line.

One development may be characterized in that the device comprises at least one insertion slot on a first side of the roller frame and at least one insertion slot on the opposite second side of the roller frame. One development may be characterized in that the device has at least two insertion slots on a first side of the roller frame and at least two insertion slots on the opposite second side of the roller frame. One development may be characterized in that the device comprises at least three insertion slots on a first side of the roller frame and at least three insertion slots on the opposite second side of the roller frame. One development may be characterized in that the insertion slots, or the insertion planes thereof, are formed without an inclination with respect to the first insertion plane, i.e. all the insertion slots are parallel to one another.

One development may be characterized in that the device comprises insertion slots that follow one another at positions P1 to Pn in the transport direction of the sheets through the roller frame, wherein n≥2 and wherein odd n are located on the first side and even n are located on the second side, and in that the first insertion slot and the second insertion slot are located at position P2. The insertion slots at the positions are preferably designed and/or oriented such that the mouth of a respectively selectively inserted folding pocket is located between two folding rollers on the inlet side of a folding nip and, at the same time, is located between two folding rollers on the outlet side of a folding nip.

One development may be characterized in that selectively a sheet diverter is arranged in or next to an insertion slot at position P1. Thus, in this case, no folding pocket is arranged at position P1.

One development may be characterized in that the selectively insertable folding pocket is arranged in the second insertion slot at position P2, and in that selectively no folding pocket(s) is/are arranged in the further insertion slot or in the further insertion slots on the second side, i.e. at least at position P4; or put another way: selectively only one folding pocket is in operation on the second side. One development may be characterized in that selectively a sheet diverter or sheet diverters is/are arranged in the further insertion slot or in the further insertion slots on the second side. One development may be characterized in that at least two sheet diverters are coupled together such that they are jointly insertable into and removable from the device.

One development may be characterized in that the further position or the further positions on the second side, i.e. at least position P4, comprise(s) a respective further insertion slot with a respective further insertion plane, and in that these further insertion planes are each formed with an inclination with respect to the first insertion plane. One development may be characterized in that these further insertion planes are each formed with an identical inclination compared with the second insertion plane. One development may be characterized in that these further insertion planes are each formed with a different inclination compared with the second insertion plane; provision may be made, for example, for a first folding pocket on the second side to be inclined at 17° or 18°, for a following second one to be inclined at 19° and for a further following third one to be inclined at 20° (in each case with regard to the first insertion plane).

One development may be characterized in that the further position or the further positions on the first side, i.e. at least position P1, comprise a respective further insertion slot with a respective further insertion plane, and in that these further insertion planes are each formed with an inclination with respect to the first insertion plane. Here, the expression "inclination with respect to the first insertion plane" also includes an inclination with respect to a plane parallel to the first insertion plane. One development may be characterized in that these further insertion planes are each formed with an identical inclination compared with the second insertion plane. One development may be characterized in that these further insertion planes are each formed with a different inclination compared with the second insertion plane.

One development may be characterized in that the inclination has a value of between 15° and 20°. One development may be characterized in that the inclination has a value of 17°.

Preferred developments of the invention as a method (developments for short) will be described in the following text. These may also—unless technically ruled out—be combined with one another.

One development may be characterized in that the sheets are fed to the device in an overlapping stream, and in that a first sheet emerges at least from one folding pocket, while a subsequent second sheet enters the folding pocket.

One development may be characterized in that a portion of the second sheet entering passes a portion of the first sheet emerging.

Other features which are considered as characteristic for the invention are set forth in the appended claims.

Although the invention is illustrated and described herein as embodied in device and method for folding sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Mutually corresponding features are identified with the same reference signs throughout the figures. Reference signs that repeat in the figures have partially been omitted for the sake of clarity.

DETAILED DESCRIPTION OF THE INVENTION

Figure 1:
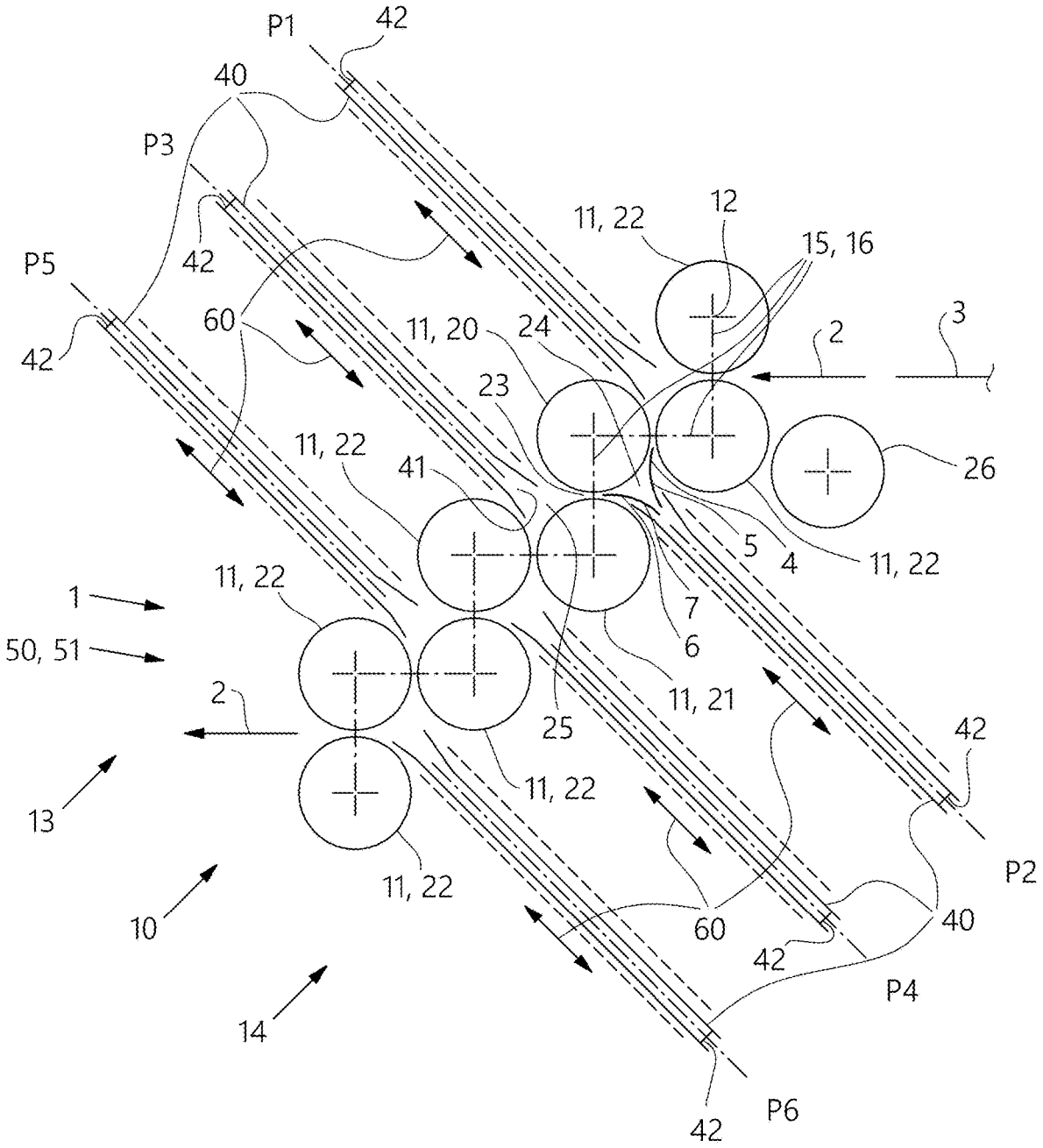
FIG.1 PRIOR ART
FIGS. 1 and 2 show a schematic illustration of a sectional view of the same device according to the prior art.
Figure 2:
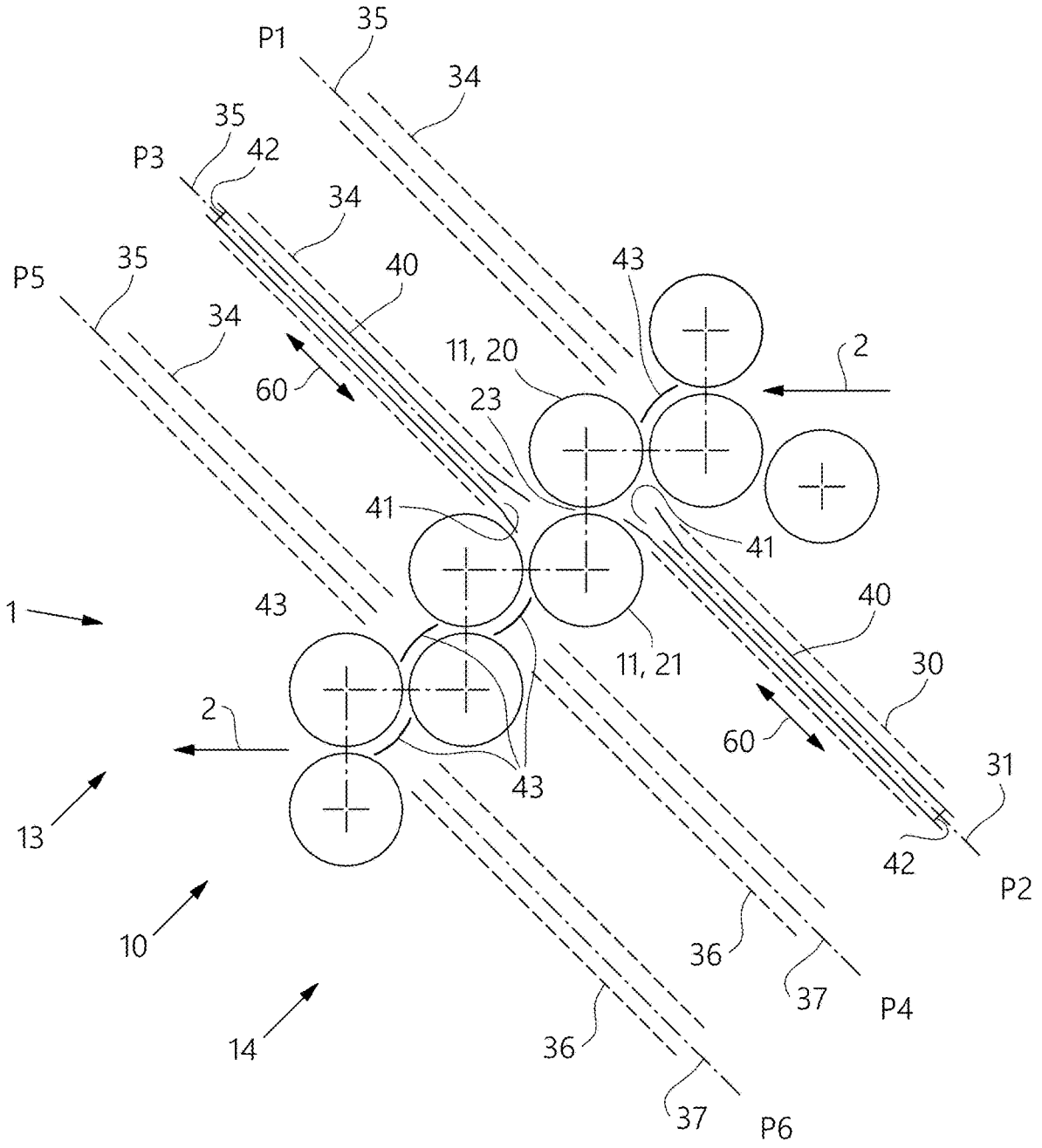
FIG. 2 PRIOR ART

Referring now to the figures of the drawing in detail, it should be noted that the technical features shown in FIGS. 1 and 2 are preferably also present in the respective exemplary embodiments of the device according to the invention shown in FIGS. 3 to 6. For this reason they will not be explained again in detail there.

FIG. 1 shows a device 1 having a transport and processing direction 2 for sheets 3 to be processed, i.e. to be folded. The sheets are preferably fed to the device 1 as an overlapping stream. The device 1 comprises a folding roller frame 10 having a plurality of folding rollers 11 that are arranged in succession. Each of the rollers 11 has an axis of rotation 12. The folding roller frame 10 defines a first side 13 (for example on the left in the figure) and a second side 14 (for example on the right in the figure). The connecting lines 15 between the axes of rotation 12 form a zigzag arrangement 16. The device 1 is preferably part of a folding machine 50 or of a folding unit 51.

FIG. 1 shows a first folding roller 20, a second folding roller 21 arranged downstream thereof, and further folding rollers 22 of the folding roller frame 10. The first folding roller 20 and the second folding roller 21 form a folding nip 23, as do respective pairs of the further folding rollers. The folding nip 23 defines an inlet side 24 and an outlet side 25, wherein a sheet 3 to be folded enters the folding nip 23 on the inlet side 24 and emerges therefrom again on the opposite outlet side 25 of the folding nip 23. The folding roller frame 10 also comprises an upstream roller 26.

FIG. 2 shows on the second side 14 a first insertion slot 30 with a first insertion plane 31, and further insertion slots 34 with further insertion planes 35 on the first side 13 and further insertion slots 36 with further insertion planes 37 on the second side 14. A buckle plate 40, also referred to as a buckle plate 40, having a buckle plate mouth 41 for a specific folding task can be selectively inserted into each insertion slot and removed therefrom again (direction 60), wherein the buckle plate mouth 41 is positioned in each case in the vicinity of a folding nip. Via the buckle plate mouth 41, a sheet 3 to be folded enters the respective buckle plate and emerges therefrom again. Each buckle plate 40 preferably has an adjustable buckle plate stop 42. The insertion slots may be located at the consecutively numbered positions P1 to P6, which correspond to respective folding nips. In FIG. 1, all six illustrated insertion slots, or all six positions P1 to P6, are equipped with buckle plates 40. In FIG. 2, only two insertion slots at the positions P2 and P3 are equipped with buckle plates 40; at the remaining positions P1 and P4 to P6, sheet diverters 43 are arranged instead.

FIG. 1 shows (only partially for illustration reasons) a sheet 4 entering a buckle plate 40 with a portion 5 and a sheet 6 emerging from the same buckle plate 40 with a portion 7, wherein the portions 5 and 7 pass one another in the case of overlapping folding. In order that no printing substrate-specific problems arise during this process, in particular when successive sheets 3 pass one another, an inclined, second insertion slot is additionally provided according to the invention. This and further inclined insertion slots are explained in the following figures.

Figure 3:
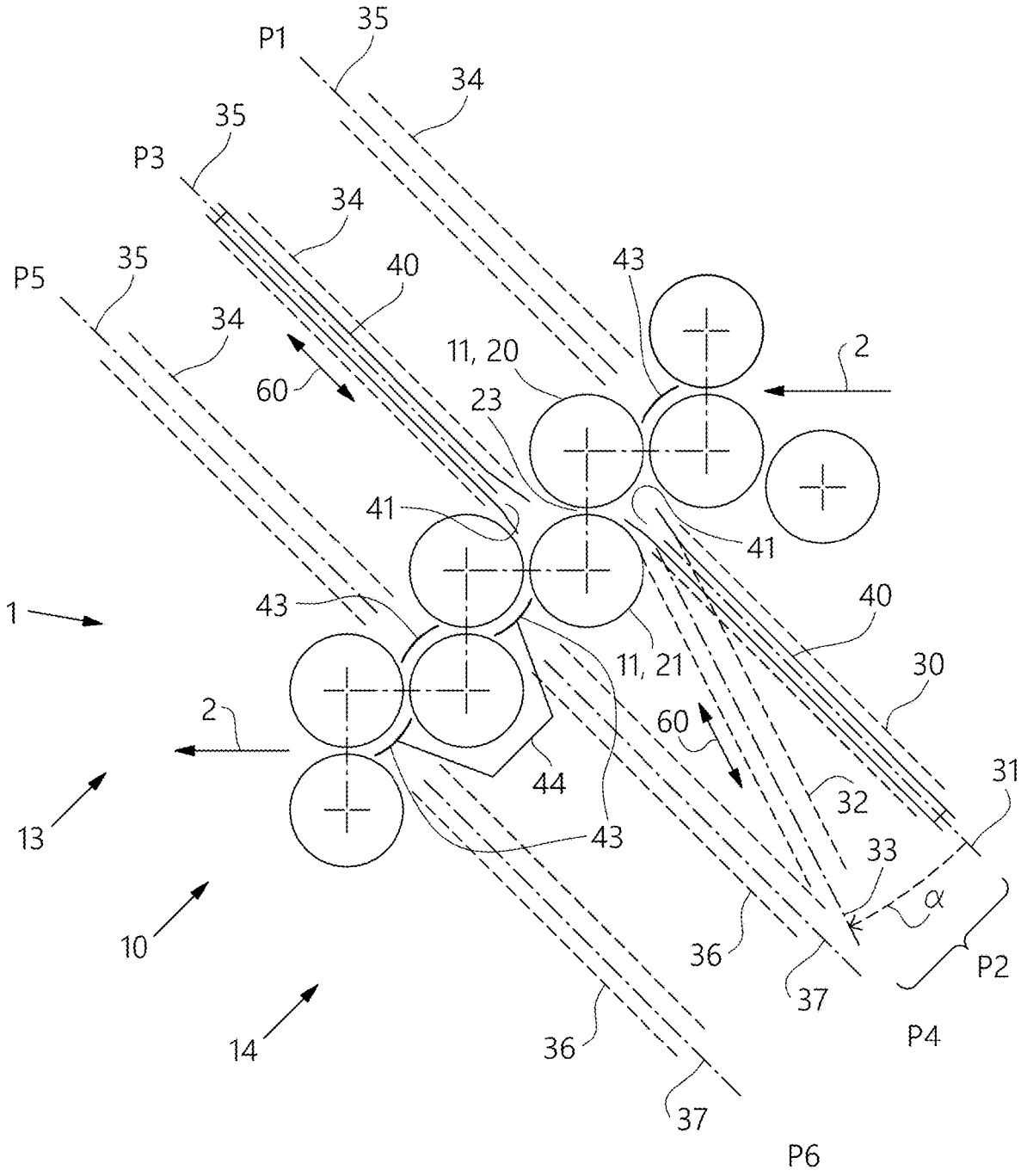
FIGS. 3 to 6 are schematic illustrations, each showing a sectional view of a preferred exemplary embodiment of the device according to the invention.

It is apparent from FIG. 3 that, in addition to the first insertion slot 30 with the first insertion plane 31 in position P2, there is a second insertion slot 32 with a second insertion plane 33 in position P2. The second insertion slot 33 is in this case inclined at the angle $\alpha$ with respect to the first insertion plane 31 (inclined downwardly by way of example in the illustration), preferably at approximately 17°.

Figure 4:
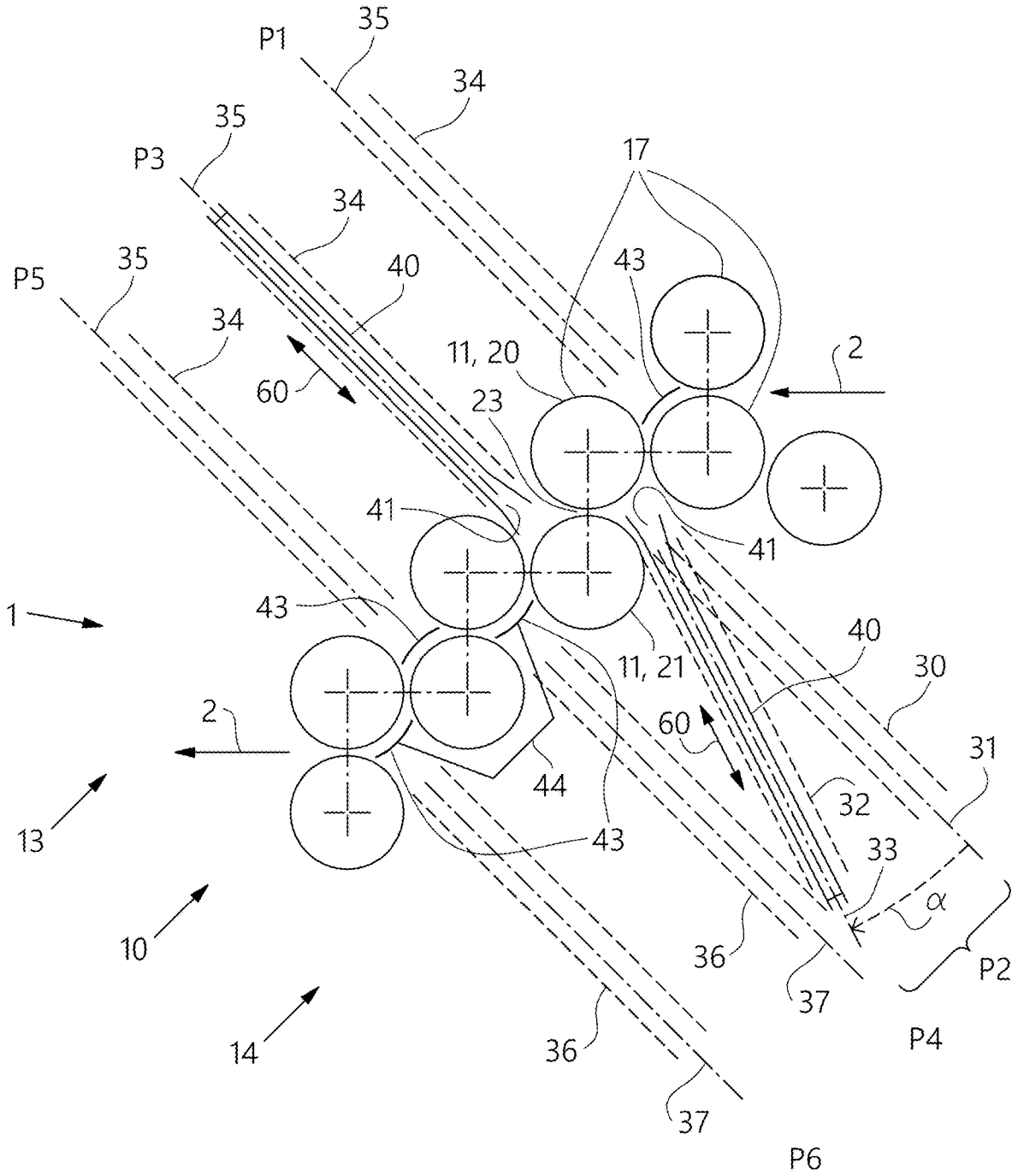

It is apparent from FIG. 4 that a buckle plate 40 having a buckle plate mouth 41 has been selectively inserted into the second insertion slot 32 for a specific folding task. Furthermore, a buckle plate 40 has also been inserted in position P3 for the specific folding task, while there are selectively no buckle plates in the further insertion slots for the specific folding task, there selectively being sheet diverters 43 there instead. The two sheet diverters at positions P4 and P6 are in this case connected mechanically together via a coupler 44 and can in this way be introduced and removed again together.

It should be noted here that the insertion slots and the buckle plates in actual folding devices are usually longer than illustrated, and that therefore the inclined insertion slot 30 and the inclined buckle plate 40 in position P2 may cross the insertion slots 36 in the positions P4 and P6. In such a case, there may be no buckle plates 40 in the positions P4 and P6 when there is a buckle plate 40 in the inclined insertion slot 32 in position P2.

Figure 5:
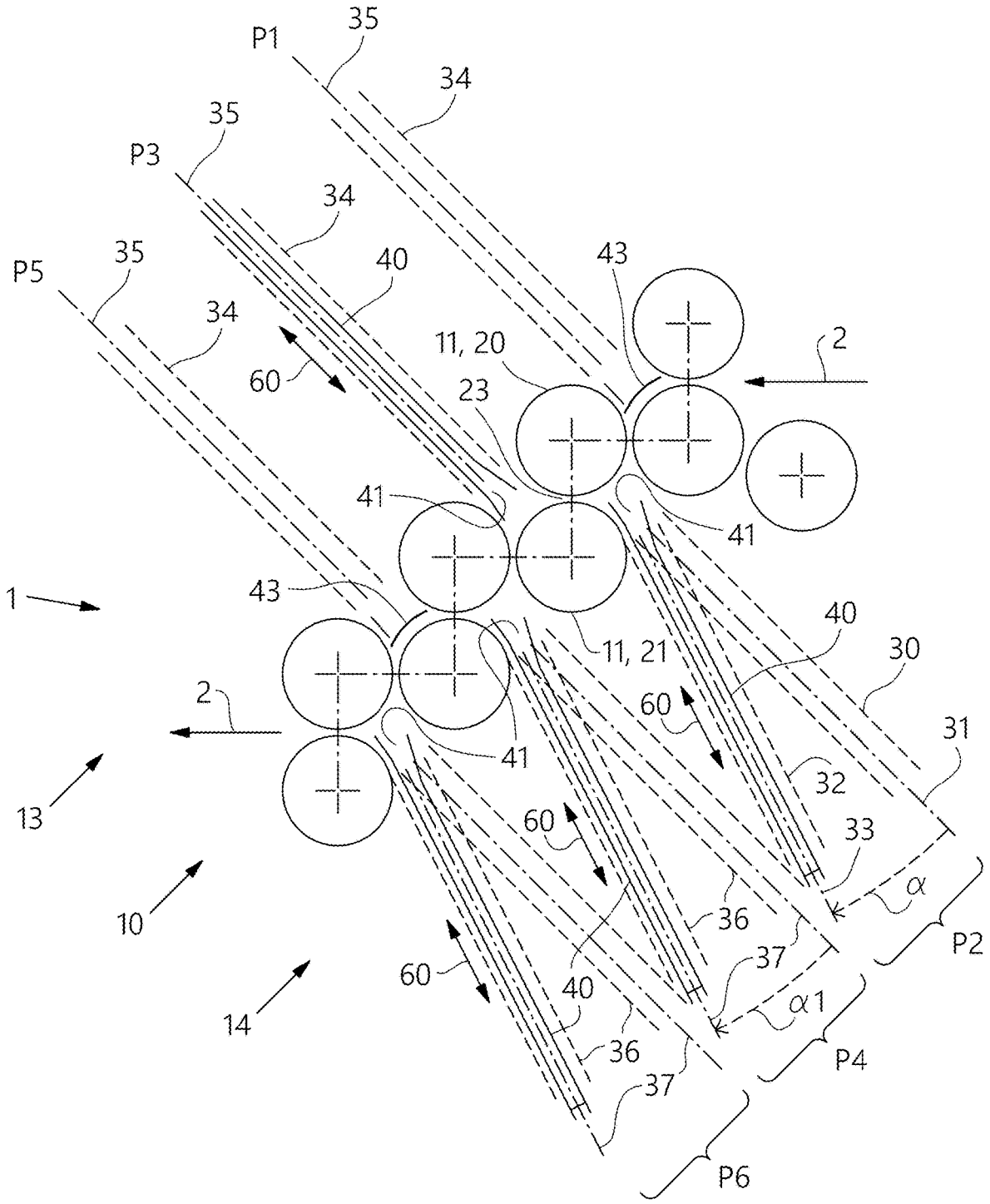
Figure 6:
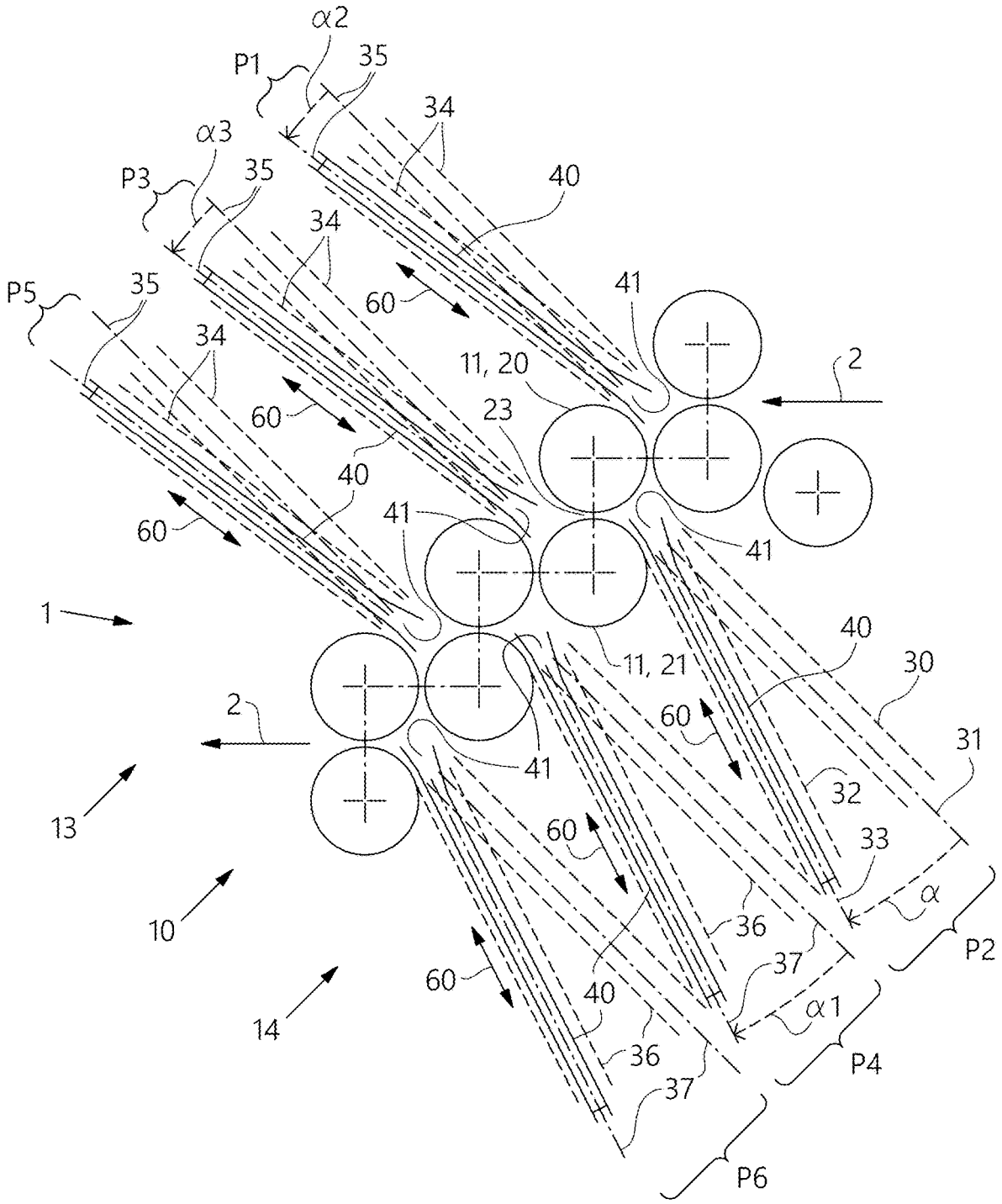

It is apparent from FIG. 5 that there may also be inclined insertion slots 36 with inclined insertion planes 37 in positions P4 and P6—in addition to the non-inclined insertion slots located there. In this case, the inclination α1 may be identical to, or different from, the inclination α. Furthermore, it is apparent from FIG. 6 that there may also be inclined insertion slots 34 with inclined insertion planes 35 on the opposite side in the positions P1, P3 and P5. In this case, the inclination α2 and/or α3 may be identical to or different than the inclination α and/or α1. If there are a plurality of insertion slots on one of the two sides 13 and 14, they may in particular be parallel to one another.

Provision may be made for the folding rollers 17 illustrated in FIG. 4 (all three of them or only the two upper ones) to be arranged in a manner offset upward by a few millimeters compared with the arrangement in FIG. 1, i.e. preferably as early as during assembly and permanently. Or put another way: the group of the two or three folding rollers 17 exhibits a spacing with respect to the group of the further folding rollers of the roller frame, this differing from, and preferably being greater than, the spacing of the respective folding rollers from one another. As a result, the angle at which a sheet 3 to be folded enters the inclined buckle plate 40 advantageously changes, as does the angle at which it emerges therefrom again.

The following is a summary list of reference numerals and the corresponding structure used in the above description of the invention:

1 Device
2 Transport direction
3 Sheet, (overlapping) stream of sheets
4 Entering sheet
5 Portion of the entering sheet
6 Emerging sheet
7 Portion of the emerging sheet
8 Folding roller frame
11 Folding rollers
12 Axes of rotation of the folding rollers
13 First side
14 Second side
15 Connecting lines
16 Zigzag arrangement or zigzag line
17 Folding rollers
18 First folding roller
21 Second folding roller
22 Further folding rollers
23 Folding nip(s)
24 Inlet side of the folding nip
25 Outlet side of the folding nip
26 Upstream roller
30 First insertion slot
31 First insertion plane
32 Second insertion slot
33 Second insertion plane
34 Further insertion slot(s) on the first side
35 Further insertion plane(s)
36 Further insertion slot(s) on the second side
37 Further insertion plane(s)
40 Buckle plate(s), Folding pocket(s)
41 Buckle plate mouth, folding pocket mouth, mouth
42 (Adjustable) buckle plate stop, buckle stop
43 Sheet diverter(s)
44 Coupler for sheet diverters
50 Folding machine
51 Folding unit
60 Direction on insertion and removal
P1-Pn Positions 1 to n
α Inclination(s) or angle(s)
α1 Inclination(s) or angle(s)
α2 Inclination(s) or angle(s)
α3 Inclination(s) or angle(s)

The invention claimed is:

1. A device for folding sheets, the device comprising:
two folding rollers forming a common folding nip having an inlet side and an outlet side;
a first insertion slot defining a first insertion plane for a selectively insertable buckle plate with a buckle plate mouth, said first insertion slot being configured to arrange said buckle plate mouth of a selectively inserted said buckle plate on the inlet side of said folding nip;
a second insertion slot defining a second insertion plane for a selectively insertable buckle plate with a buckle plate mouth, said second insertion plane formed by said second insertion slot being disposed with an inclination relative to said first insertion plane formed by said first insertion slot; and
said second insertion slot being configured to arrange said buckle plate mouth of a selectively inserted said buckle plate on the inlet side of said folding nip.

2. The device according to claim 1, wherein the selectively insertable said buckle plate is arranged either in said first insertion slot or in said second insertion slot.

3. The device according to claim 1, further comprising a roller frame with said two folding rollers and at least two further folding rollers.

4. The device according to claim 3, further comprising at least one insertion slot on a first side of said roller frame and at least one insertion slot on an opposite, second side of said roller frame.

5. The device according to claim 4, wherein said insertion slots and the insertion planes thereof are not inclined with respect to the first insertion plane.

6. The device according to claim 3, comprising insertion slots that follow one another at positions P1 to Pn in a transport direction of the sheets through said roller frame, wherein n≥2 and wherein odd n are located on a first side and even n are located on a second side, and wherein said first and second insertion slots are located at a position P2.

7. The device according to claim 6, which further comprises a sheet diverter selectively arranged in or next to a respective said insertion slot at a position P1.

8. The device according to claim 6, wherein the selectively insertable said buckle plate is arranged in said second insertion slot at the position P2, and wherein no selectively inserted buckle plate is arranged in the further said insertion slot or in the further said insertion slots on the second side.

9. The device according to claim 8, which comprises a sheet diverter or sheet diverters arranged in said further insertion slot or in the further said insertion slots on the second side.

10. The device according to claim 9, wherein at least two said sheet diverters are coupled to one another and configured to be jointly insertable into and removable from the device.

11. The device according to claim 6, wherein the further position on the second side in position P4 comprises a respective further insertion slot with a further insertion plane, and wherein said further insertion plane is inclined with respect to said first insertion plane.

12. The device according to claim 6, wherein the further positions on the second side comprise further insertion slots with respective further insertion planes, and wherein said further insertion planes are inclined with respect to said first insertion plane.

13. The device according to claim 12, wherein said further insertion planes are disposed with an identical inclination as said second insertion plane.

14. The device according to claim 12, wherein said further insertion planes are disposed with different inclinations from said second insertion plane.

15. The device according to claim 6, wherein the further position on the first side in position P1 comprises a respective further insertion slot with a respective further insertion plane, and wherein said further insertion plane is inclined relative to said first insertion plane.

16. The device according to claim 6, wherein the further positions on the first side comprise further insertion slot with respective further insertion planes, and wherein said further insertion planes are inclined with respect to said first insertion plane.

17. The device according to claim 16, wherein said further insertion planes are disposed with an identical inclination as said second insertion plane.

18. The device according to claim 16, wherein said further insertion planes are disposed with different inclinations from said second insertion plane.

* * * * *